US005279078A

United States Patent [19]

Enegren

[11] Patent Number: 5,279,078

[45] Date of Patent: Jan. 18, 1994

[54] METHOD FOR CLEANING ARTICLES

[75] Inventor: Paul L. Enegren, Wichita, Kans.

[73] Assignee: S. G. Enegren, Wichita, Kans.

[21] Appl. No.: 906,738

[22] Filed: Jun. 30, 1992

Related U.S. Application Data

[63] Continuation of Ser. No. 388,163, Jul. 31, 1989, Pat. No. 5,134,811.

[51] Int. Cl.[5] ..... B24C 3/04; B24C 9/00

[52] U.S. Cl. ..... 51/322; 51/319; 222/413; 384/451; 384/447

[58] Field of Search ..... 51/419, 426, 425, 424, 51/421, 410, 322, 319; 222/413; 384/451, 447

[56] References Cited

U.S. PATENT DOCUMENTS

| | | | |
|---|---|---|---|
| 2,230,579 | 2/1941 | Wintroath | 384/447 |
| 2,468,014 | 4/1949 | Keefer | 51/419 |
| 4,326,362 | 4/1982 | Williams et al. | 51/426 |
| 4,635,408 | 1/1987 | Burke et al. | 51/292 |

FOREIGN PATENT DOCUMENTS 0638235 10/1936 Fed. Rep. of Germany ..... 384/447

*Primary Examiner*—Robert A. Rose

*Attorney, Agent, or Firm*—John Wade Carpenter

[57] ABSTRACT

A method for cleaning articles with pellets. The apparatus has a housing where an article can be cleaned with pellets. A first auger is rotatably disposed in the housing and rotatably passes therethrough for conveying pellets out of the housing after the pellets have been discharged into the housing for contacting an article for cleaning. A second auger is rotatably disposed on the outside of the housing and communicates with the first auger for receiving and transporting pellets therefrom. The second auger has a sleeve having a structure defining at least one opening wherethrough pellets pass after being transported. A rotating impeller is mounted on a side of the housing and receives the pellets through the opening of the sleeve and propels the pellets towards the article. As the pellets contact the article, the article is abrasively cleaned.

14 Claims, 11 Drawing Sheets

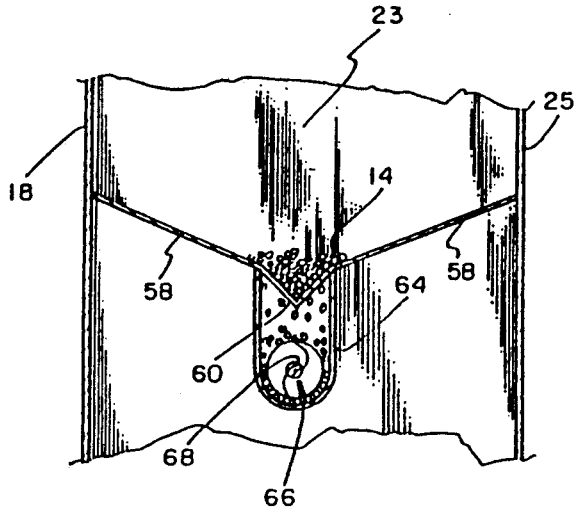
FIG. 8
FIG. 9
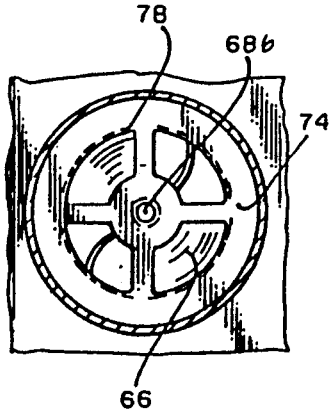
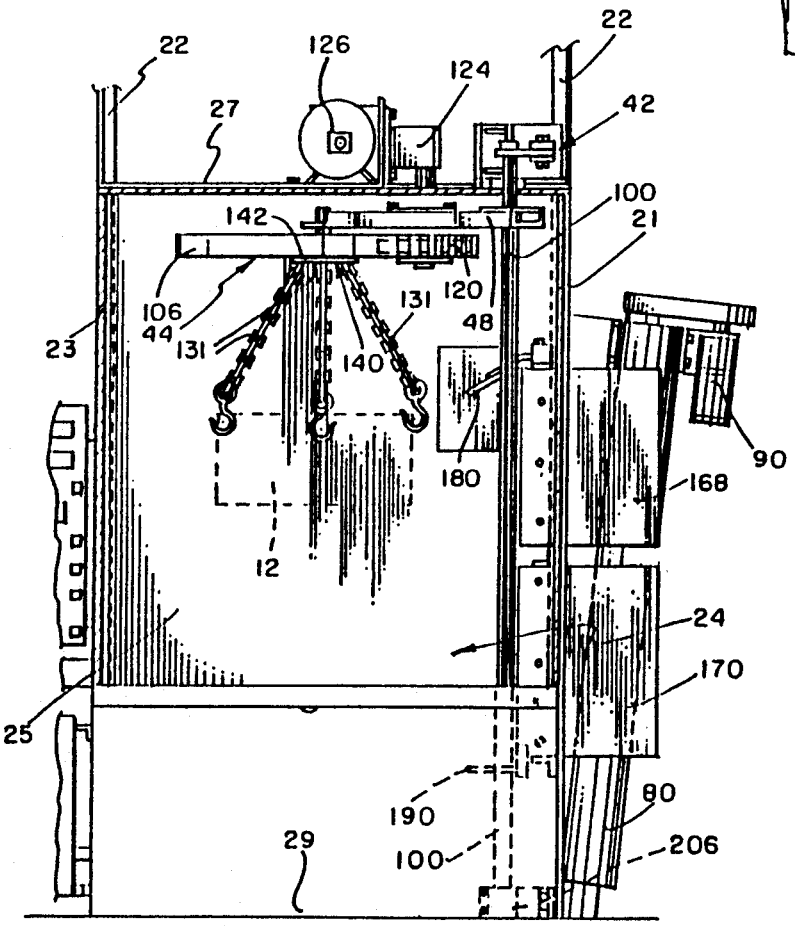
FIG. 10

METHOD FOR CLEANING ARTICLES

This is a continuation application of copending application No. 07/388,163, filed Jul. 31, 1989, now U.S. Pat. No. 5,134,811.

FIELD OF THE INVENTION

This invention relates to an apparatus for cleaning articles. More particularly, this invention provides an apparatus and a method for abrasively cleaning articles, such as with pellets.

DESCRIPTION OF THE PRIOR ART

A patentability investigation was conducted on the subject invention and the following U.S. patents were discovered U.S. Pat. No. 3,797,174 to Hazlewood; U.S. Pat. No. 3,546,816 to Enegren; U.S. Pat. No. 3,742,650 to Graf et al.; U.S. Pat. No. 2,724,929 to Moore; U.S. Pat. No. 3,362,109 to Wallace; and U.S. Pat. No. 2,925,689 to Peterson. None of the foregoing prior art U.S. patents teach the subject apparatus and method of this invention.

SUMMARY OF THE INVENTION

The present invention accomplishes its desired objects by broadly providing an apparatus for cleaning articles with pellets. The apparatus has a housing means where an article can be cleaned with pellets. A first auger means is rotatably disposed in the housing means and rotatably passing therethrough for conveying pellets out of the housing means after the pellets have been discharged into the housing means for contacting an article to clean the same. A second auger means is rotatably disposed on the outside of the housing means and communicates with the first auger means for receiving and transporting pellets therefrom. The second auger means has a sleeve including a structure defining at least one opening wherethrough pellets pass after being transported. The apparatus also has at least one means for propelling pellets towards said article. The means for propelling pellets is mounted in a side of the housing means and communicates with the opening of the sleeve for receiving pellets from the opening and for propelling the same towards the article to contact the article for abrasively cleaning the same.

The apparatus additionally comprises a mean for holding the article while the latter is being cleaned with pellets, and the means for holding is pivotally disposed in the housing means. The means for holding comprises an arm pivotally secured to the housing means, and a first wheel means, rotatably secured to said arm, for supporting said article. A plurality of sheaves is rotatably mounted to the first wheel means, and a take-up pulley is rotatably mounted to the arm. An endless belt is entrained over the sheaves and the take-up pulley. The apparatus of this invention also comprises a second wheel means for rotating the first wheel means. The second wheel means is rotatably secured to the housing means and is disposed such that the first wheel means can contact the second wheel means for rotating the same. A wheel drive means is coupled to the second wheel means for rotating the same. The first auger means comprises a first auger shaft with a first shaft axis, and the second auger means comprises a second auger shaft having a second shaft axis that defines an oblique angle with respect to said first shaft axis. The second auger shaft has a shaft end rotatably engaged with an auger shaft bearing means comprising a plurality of the pellets.

The present invention also accomplishes its desired objects by broadly providing a method for cleaning articles with pellets comprising the steps of:

(a) providing a housing means for cleaning articles and a first auger means rotatably disposed therein and rotatably passing therethrough for conveying pellets out of the housing means after the pellets have been discharged therein for contacting an article for cleaning the same;

(b) providing a second auger means rotatably disposed on the outside of the housing means and communicating with the first auger means for receiving and transporting pellets therefrom;

(c) providing at least one means for propelling pellets towards an article disposed in the housing means, said means for propelling being provided such as to communicate with the second auger means for receiving pellets therefrom;

(d) disposing an article in the housing means;

(e) propelling pellets towards the article of step (d) with the means for propelling pellets of step (c);

(f) conveying pellets with the first auger means out of the housing means and discharging the pellets into the second auger means; and (g) transporting the pellets with the second auger means into the means for propelling pellets of step (c) such that the means for propelling pellets can propel the pellets towards the article.

The method for cleaning articles with pellets additionally includes rotating the article about a first axis in the housing means, and simultaneously rotating the article about a second axis in the housing means. The method encompasses forming an auger shaft bearing means with the pellets at an end of the second auger means.

The present invention also further accomplishes its desired objects by broadly providing a method for forming a bearing for an auger means that transports pellets comprising the steps of:

(a) providing a housing means for receiving pellets and having disposed therein a means for conveying pellets from the inside of the housing means to the outside of the housing means;

(b) providing a bearing housing means, communicating with the means for conveying pellets, for receiving pellets conveyed by the means for conveying;

(c) disposing an end of an auger shaft of an auger means in the bearing housing means such that pellets conveyed from the means for conveying pellets fall into the bearing housing means to surround the end of the auger shaft; and (d) transporting pellets with the means for conveying pellets until the pellets fall into the bearing housing means to surround the end of the auger shaft and thereby form a bearing for the auger means.

The present invention still yet further accomplishes its desired objects by broadly providing a hanger for holding an article which is to be cleaned in a housing. The hanger of the present invention comprises a hanger arm which is to be pivotally secured within a housing. A first wheel member is pivotally secured to the hanger arm. The hanger also includes a second wheel member which is to be rotatably secured to the housing and is for contacting the first wheel member to drive the same. A plurality of sheaves is rotatably connected to the first wheel member. Also broadly provided herein is a method for holding an article while it is being cleaned in a housing comprising the steps of:

(a) securing an article to a first member having a first axis in a housing;

(b) securing the first member to a second member having a second axis in the housing;

(c) rotating the article with the second member about the second axis with the second member; and (d) rotating, simultaneously with the rotating step (c), the article with the first member about the first axis.

It is therefore an object of the present invention to provide a method and an apparatus for cleaning articles with pellets.

It is another object of the present invention to provide a method for forming a bearing for an auger means that transports pellets.

It is yet another object of the present invention to provide a hanger for holding an article which is to be cleaned in a housing, and a method for holding an article while it is being cleaned in a housing.

These, together with the various ancillary objects and features which will become apparent to those skilled in the art as the following description proceeds, are attained by this novel apparatus and method, a preferred embodiment being shown with reference to the accompanying drawings, by way of example only, wherein:

BRIEF DESCRIPTION OF THE DRAWINGS

FIG. 8 is a vertical sectional view taken in direction of the arrows and along the plane of line 8—8 in FIG. 5;

FIG. 9 is a vertical sectional view taken in direction of the arrows and along the plane of line 9—9 in FIG. 6;

FIG. 10 is a vertical sectional view taken in direction of the arrows and along the plane of line 10—10 in FIG. 7;

DETAILED DESCRIPTION OF THE INVENTION

Figure 3:
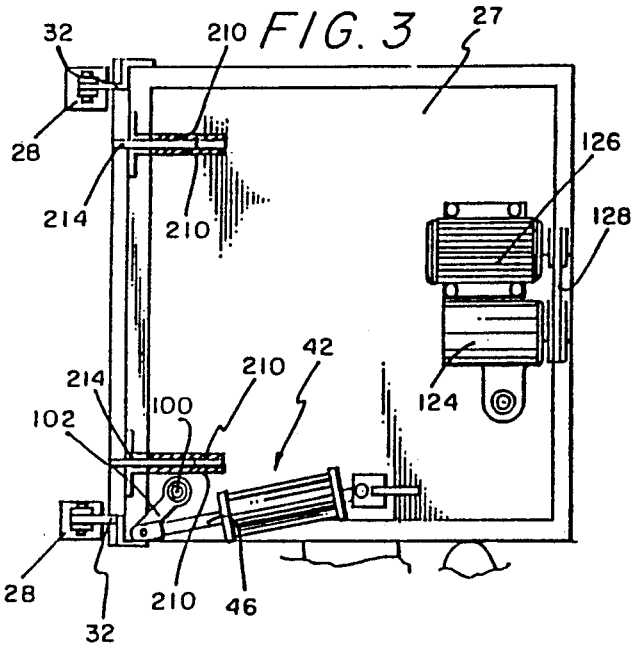
FIG. 3 is a top plan view of the apparatus in FIG. 2.
Figure 2:
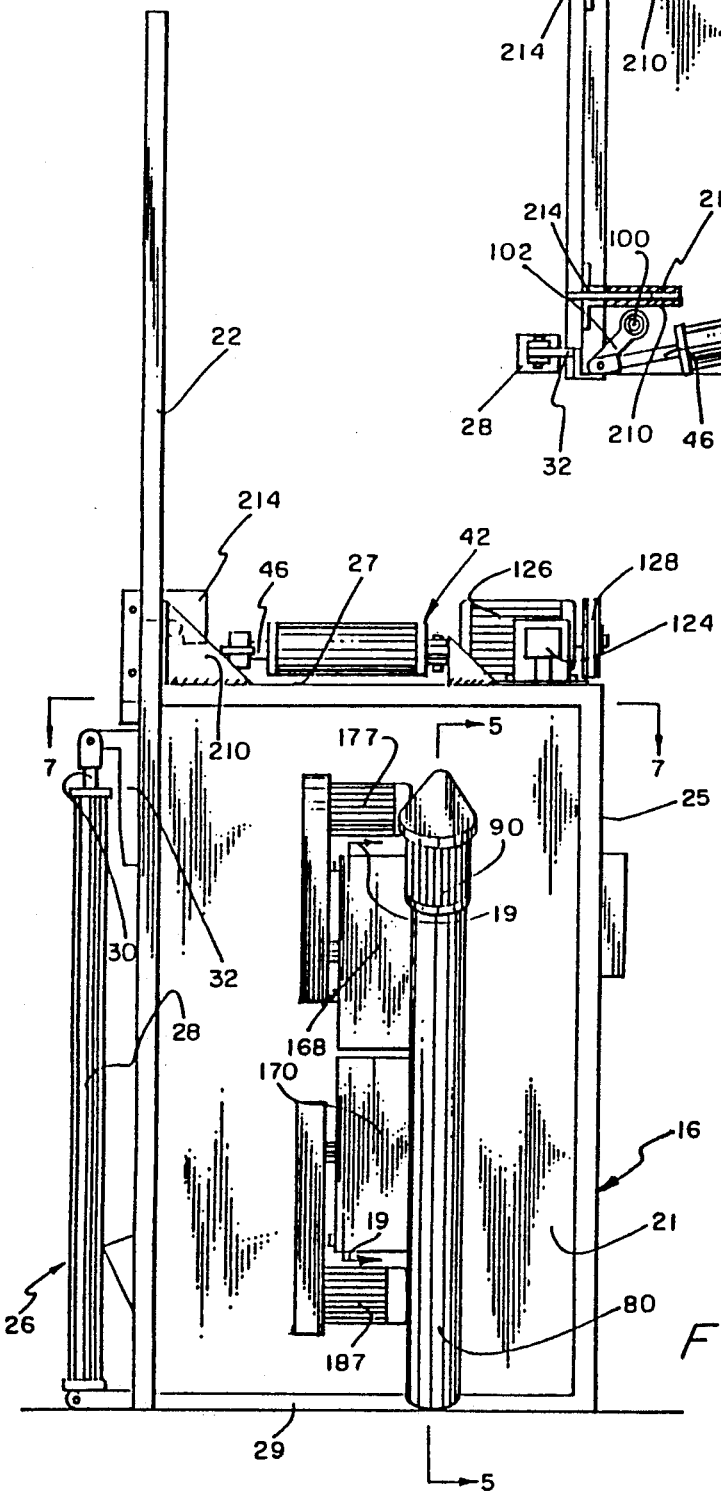
FIG. 2 is an end elevational view of the apparatus in FIG. 1.
Figure 11:
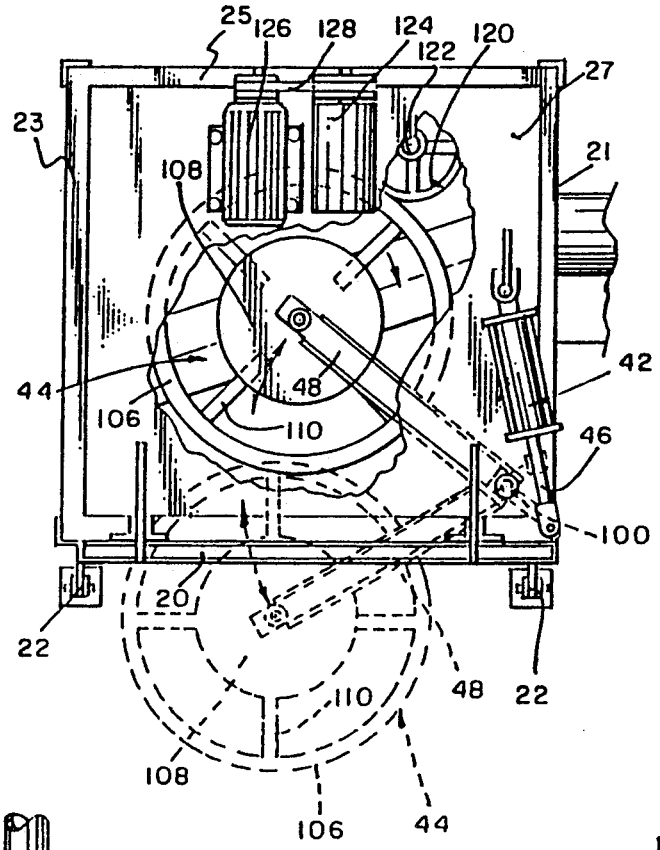
FIG. 11 is a segmented top plan view of the apparatus of the present invention with part of the top removed in order to expose the hanger pivotally disposed within the housing of the apparatus.

Referring in detail now to the drawings wherein similar parts of the invention are identified by like reference numerals, there is seen the apparatus of this invention, generally illustrated as 10, and which functions to abrasively clean articles, especially metallic articles 12 (see dotted line representation in FIG. 10) which are cleaned by being pelletized with pellets 14. A dust collector 11 is disposed contiguously to the apparatus 10 and includes a conduit 13 for communicating with the apparatus 10 for collecting dust from the same. The apparatus 10 includes a housing, generally illustrated as 16, wherein in a preferred embodiment of the invention the articles 12 are cleaned with the pellets 14. The housing 16 has a front 18; a pair of sides 21 and 23 secured to the front 18; a back 25 secured to the pair of sides 21 and 23; a top 27 and a bottom 29, both of which are secured to the front 18, to the back 25, and to the pair of sides 21 and 23. The front 18 generally partly represents a door 20 that is capable of being raised and lowered along a pair of tracks (or the like) 22-22 such as to provide an opening, generally illustrated as 24 in FIGS. 5 and 10, wherethrough the articles 12 can be passed for entry into and removal from the housing 16. Coupled to the door 20 is a means, generally illustrated as 26, for raising and lowering the door 20. Preferably, the means 26 is a pair of pneumatic cylinder means 28-28, with each having a piston 30 that is coupled pivotally to a door bracket 32 (see FIG. 2 and 3) bound to the top of the door 20. When it is desired to raise the door 20, pressured air (or the like) is released and directed by a valve 38 from a compressor or air reservoir 34 via conduit 54 through conduits 36-36 and into the two pneumatic cylinder means 28-28 to drive the two pistons 30-30 upwardly (see FIG. 27) to expand the length of same outside of the cylinder means 28-28 in order to expose the opening 24. As will be more fully explained below, a valve 33 is also provided and operates independently of the valve 38 that causes the door 20 to open for exposing the opening 24. Valve 33 releases pressured air from compressor or air reservoir 34 via conduit 56 through a conduit 40 or a conduit 52, and into a hanger pneumatic cylinder means, generally illustrated as 42. The cylinder means 42 is mounted on the top 27 of the housing 16 and operates when air is being released by valve 33 through conduit 40 for causing or effecting a hanger means, generally illustrated as 44 and coupled to a piston 46 of the hanger pneumatic cylinder means 42 via a hanger arm 48, to swing outwardly towards and through the opening 24 (see dotted line representation in FIG. 11) to facilitate the securing and removal of articles 12 held suspendedly thereby. Similarly, when valve 33 is releasing pressurized air through conduit 52, it causes or effects the hanger means 44 to swing inwardly through the opening 24 and into the inside of the housing 16. As will be more fully explained below, the releasing of pressurized air through conduit 52 by valve 33 also causes a structural portion (i.e., a hanger wheel identified as 106 below) of the hanger means 44 to be placed in biasing contact with a drive means (i.e., a drive wheel identified as 120 below) to effect rotation of the structural portion of the hanger means 44. It is to be understood that each of the valves 33 and 38 has a neutral position where pressurized air is released from all conduits. When valve 33 and/or valve 38 are moved to release pressurized air from within one conduit(s) and to direct pressurized air into another conduit(s), the first movement of the valve 33 and/or valve 38 is into the neutral position where the pressurized air is released from within the one conduit that previously contained the pressurized air and all conduits do not communicate with the compressor 34; and the next or subsequent movement of the valve 33 and/or valve 38 would be opening up of communication of the other conduit(s) with the compressor 34 while keeping the one conduit from communicating with the compressor 34.

When it is desired to lower the door 20 after the hanger means 44 has been disposed inside of the housing 16 in accordance with the procedure indicated, valve 38 is moved such that pressurized air from the compressor or air reservoir 34 is released into and through conduits 50-50 and into the pneumatic cylinder means 28-28 to drive the expanded two pistons 30-30 downwardly to lessen the length of same outside of the cylinder means 28-28, all of which causes the opening 24 to close off due to the lowering of the door 20. As was previously indicated, before valve 38 releases pressurized air into conduits 50-50, it has released the pressurized air from within conduits 36-36 which caused the door 20 to open to expose the opening 24.

Figure 5:
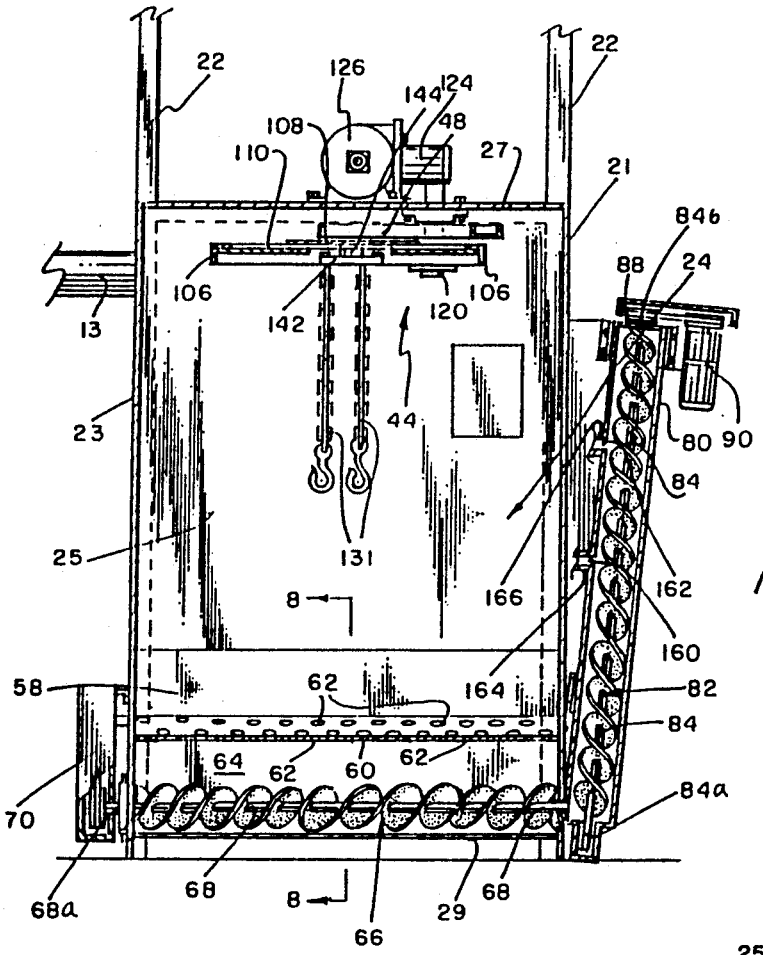
FIG. 5 is a vertical sectional view taken in direction of the arrows and along the plane of line 5—5 in FIG. 2.
Figure 15:
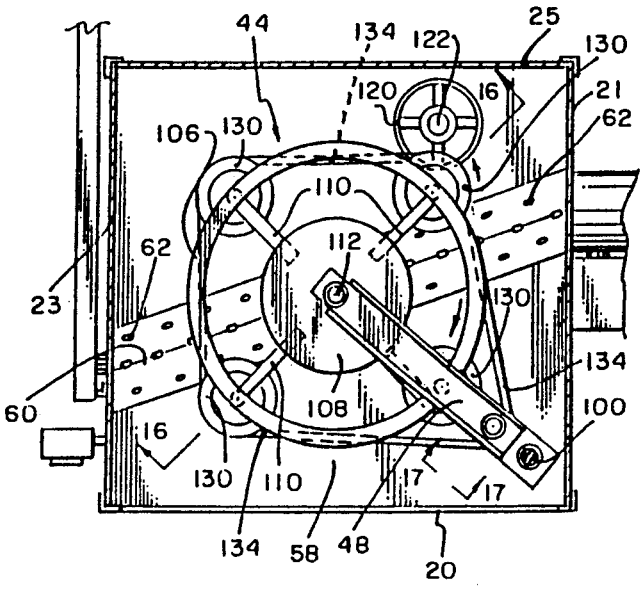
FIG. 15 is a top plan view of a horizontal sectional view exposing the hanger pivotally mounted on the inside of the housing of the apparatus.
Figure 16:
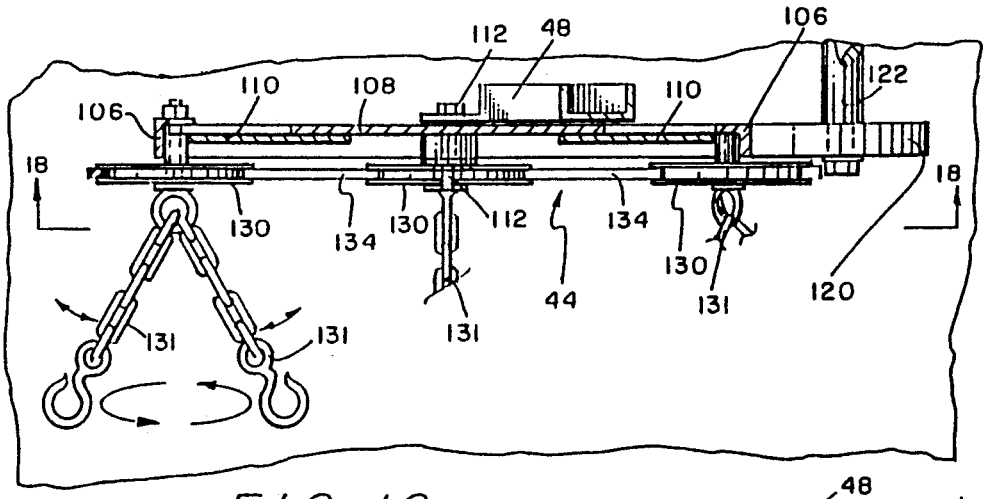
FIG. 16 is a vertical sectional view taken in direction of the arrows and along the line of plane 16—16 in FIG. 15.

As best illustrated in FIG. 8, the housing 16 is formed with a pair of downwardly sloping floors 58-58 which connect to the pair of sides 21 and 23 and to the front 18 and to the back 25. The floors 58-58 meet to form a trough 60 which has a structure with a plurality of apertures 62 (see FIGS. 5, 7 and 15) wherethrough pellets 14 can fall by gravity. Communicating with the apertures 62 and disposed generally directly underneath the trough 60 is an auger housing 64 for receiving the pellets that have fallen through the apertures 62. An auger means, generally illustrated as 66, is rotatably disposed in the auger housing 64 such as to move the pellets 14 that have fallen into the auger housing 64 towards the side 21. The auger means 66 has an auger shaft 68 with opposed ends **68*a* and 68*b* and an axis that is generally horizontal and parallel to the ground. End 68*a* of auger shaft 68 rotatably extends through the side 23 where it is coupled to an auger motor 70 in order to be rotatably driven. The auger motor 70 functions as a drive means for the auger means 66. A switch 72 (see FIG. 27) is provided such that when closed, the auger motor 70 is energized or activated by electrically being in direct communication with a power source. The end 68*b* (see FIGS. 6 and 9) of the auger shaft 68 is rotatably supported by an auger partition 74 disposed within close proximity to the side 21 which includes a common opening 76 (see FIG. 6) in communication with the partition 74. Partition 74 has a plurality of partition apertures 78 wherethrough pellets 14 are passed by the auger means 66 to exit through the common opening 76 and into the lower part of a sleeve or auger housing 80 which is also formed with the common opening 76. Rotatably disposed in the sleeve or auger housing 80 is an auger means, generally illustrated as 82, which functions to move vertically the pellets 14 received from the auger means 66 through the common opening 76. The auger means 82 has an auger shaft 84 with opposed ends 84*a* and 84*b* and an axis that is off-set or canted with respect to a vertical plane. Stated alternatively, in one embodiment of the invention as depicted in FIG. 5, the axis of the auger shaft 84 is disposed at an acute angle, say from about 1 degree to about 45 degrees, with respect to a vertical plane; or the axis of the auger shaft 84 is disposed at an oblique angle, say from about 91 degrees to about 135 degrees, with respect to the axis of the auger shaft 68. In this embodiment of the invention, the auger means 82 conveys the received pellets 14 up and away from the housing 16, more particularly up and away from the side 21. Thus, after the pellets 14 contact the articles 12 and fall through the apertures 62 and into the trough 64, auger means 66 conveys the pellets 14 along a path that is generally horizontal or parallel with respect to the ground surface. After the pellets 14 are conveyed through the partition aperture 78 and through the common opening 76 by the auger means 66, the pellets 14 pass into the sleeve or auger housing 80 where the received pellets 14 are conveyed by the auger means 82 along a path forming the oblique angle with the path of the pellets 14 being conveyed with the auger means 66**.

Figure 29:
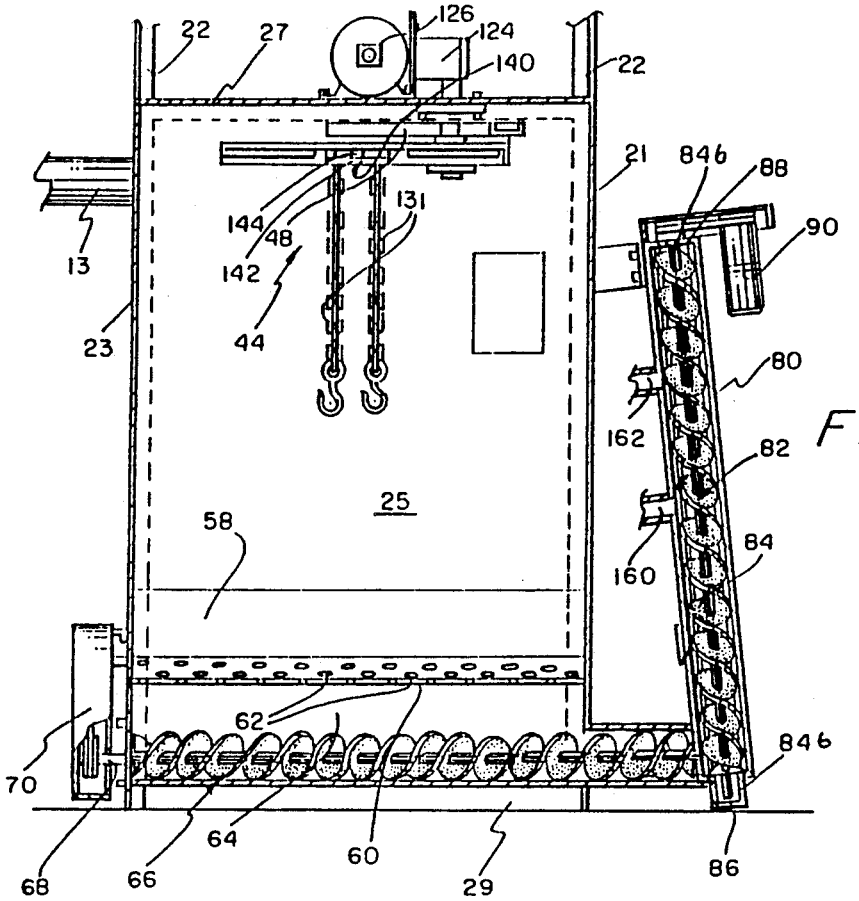
FIG. 29 is a partial vertical sectional view of another embodiment of the apparatus in FIG. 5.
Figure 28:
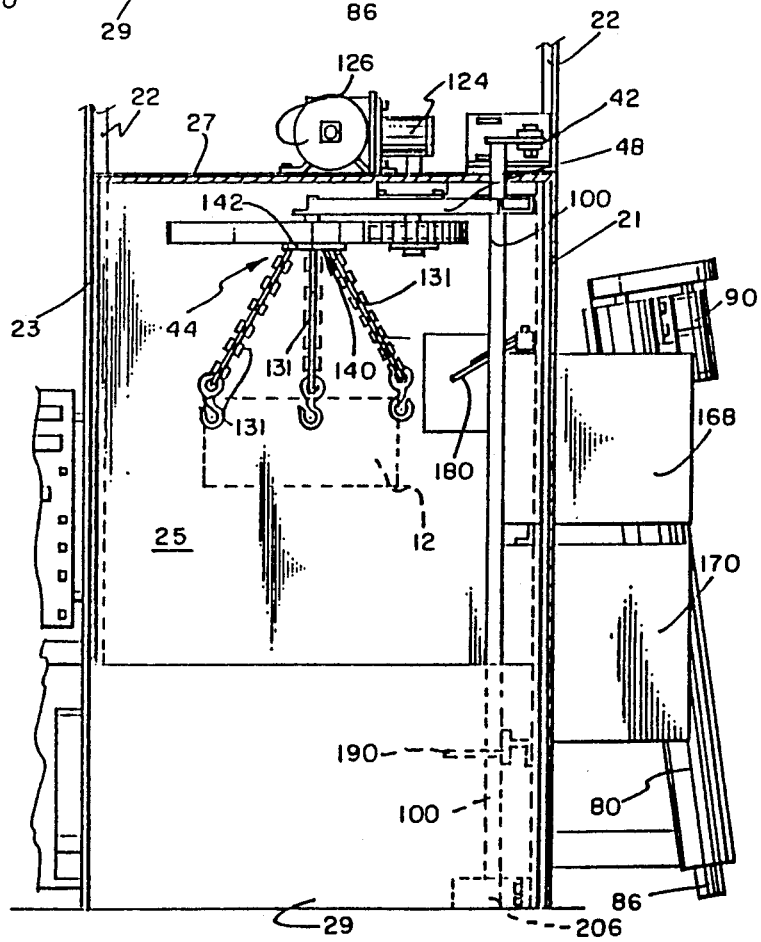
FIG. 28 is a partial vertical sectional view of another embodiment of the apparatus in FIG. 10.

In another embodiment of the invention as depicted in FIGS. 28 and 29, the axis of the auger shaft 84 is disposed at an acute angle (e.g. from about 45 degrees to about 89 degrees) with respect to the axis of the auger shaft 68. In this embodiment, the auger means 82 conveys the received pellets 14 up and towards the housing 16, more particularly up and towards the side 21. Therefore, received pellets 14 from auger means 66 are conveyed by the auger means 82 in FIG. 28 and 29 along a path forming the acute angle with the path of the pellets 14 being conveyed with the auger means 66.

Figure 6:
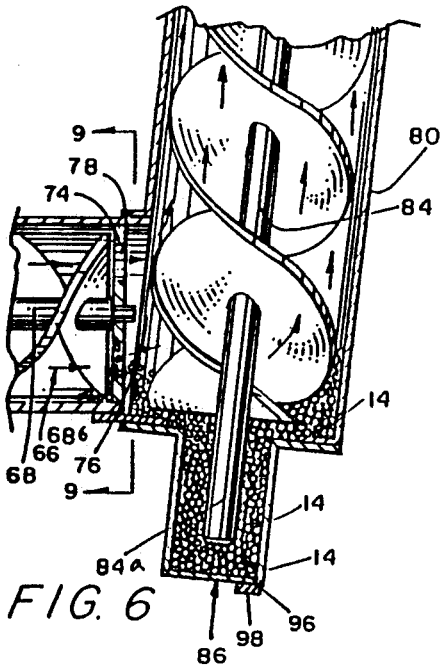
FIG. 6 is a partial enlarged vertical sectional view of one of the augers conveying pellets into the housing or sleeve of a second auger and with the pellets forming a bearing at the end of the sleeve or auger housing of the second auger.
Figure 7:
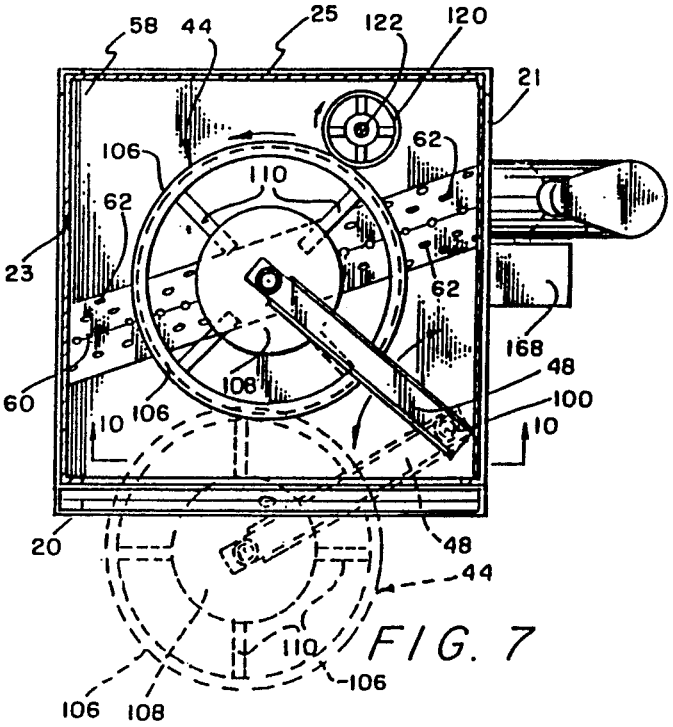
FIG. 7 is a horizontal sectional view taken in direction of the arrows and along the plane of line 7—7 in FIG. 2.

The lower part of the sleeve or auger housing 80 is formed with a bearing housing, generally illustrated as 86 (see FIG. 6). More specifically, the lowermost open end of the sleeve or auger housing 80 communicates directly with the bearing housing (or container) 86 that has been connected to the lowermost end of same. The end **84*b* of the auger shaft 84 is rotatably secured to a bearing 88 mounted at the uppermost end of the sleeve or auger housing 80 such that the end 84*a* of the auger shaft 84 is rotatably disposed in the bearing housing 86 in a spaced relationship with respect to the wall or side of the bearing housing 86, as best shown in FIGS. 5 and 29. The end 84*b* of the auger shaft 84 is coupled to an auger motor 90 in order to be rotatably driven for moving pellets 14 vertically or upwardly. The auger motor 90 functions as a drive means for the auger means 82. A switch 92 (see FIG. 27) is furnished such that when closed, the auger motor 90 is energized or activated by electrically being in direct communication with a power source. After the pellets are passed or transported through the opening 76 by the auger means 66, the pellets 14 are received by the sleeve or auger housing 80 and fall into the bearing housing 86 to surround the end 84*a* of the auger shaft 84 and thereby form a bearing for the auger means 82 (more particularly for the end 84*a* of the auger shaft 84 for the auger means 82). Such formed bearing comprises a plurality of the pellets 14. Alternatively, the end 84*a* of the auger shaft 84 may be embedded in a plurality of the pellets 14 prior to transporting any pellets 14 into the bearing housing 86 with the auger means 66. This placement of pellets 14 can take place by manually or otherwise disposing pellets 14 in the bearing housing 86 for surrounding the end 84*a* of the auger shaft 84, and such disposition can be accomplished at the time of assembling the auger means 82 within the auger housing 80. Thus, the pellets 14 in the present invention function not only for pelletizing any articles 14 to be cleaned, but also function as a bearing for the auger shaft 84 of the auger means 82. It is to be understood that at times one or more of the pellets 14 may be removed or displaced from the bearing housing 86 with or by the auger means 82, more specifically with or by the rotating end 84*a* of the auger shaft 84. Any removed or displaced pellets 14 can or may be replaced or replenished by the auger means 66 continuing to convey or transport pellets 14 through the common opening 76 for falling into the bearing housing 86**.

Typically, as the auger means 82 (including the shaft 84) is rotated by the motor 90 for transporting or conveying pellets 14 vertically, one or more of the pellets 14 may become damaged from time to time, to the degree of becoming particulated, or otherwise generally crushed into finer particles or pieces. Such damaged pellets 14 may be replaced periodically if the bearing housing 86 is provided with an optional aperture 96 normally plugged or closed (or otherwise covered) by a bearing cover 98 (see FIG. 6). Forming the bearing housing 86 with aperture 96 is optional and is not necessary in operation of the invention. Should the bearing housing 86 be formed with the aperture 96 and bearing cover 98, the pieces of crushed or damaged pellets 14 may be removed by removing the bearing cover 98 to allow the pieces to fall out of the bearing housing 86, or to otherwise be removed therefrom. Typically, the aperture 96 should have a diametrical opening or size smaller than the diameter or size of the pellets 14 such that the pellets 14 remain in the bearing housing 86 while the pieces of the pellets 14 would be allowed to fall freely therethrough. After a period of time the pieces of the pellets 14 would tend to accumulate at the bottom of the bearing housing 86 and thus would be readily available for removal through aperture 96. After removal of the pieces of pellets 14 from the bearing housing 86, the pellets 14 made up by the various pieces removed from the bearing housing 86 are replaced when the auger means 66 has transported or conveyed additional pellets 14 through the common opening 76 such as to fall into the bearing housing 86.

Figure 19:
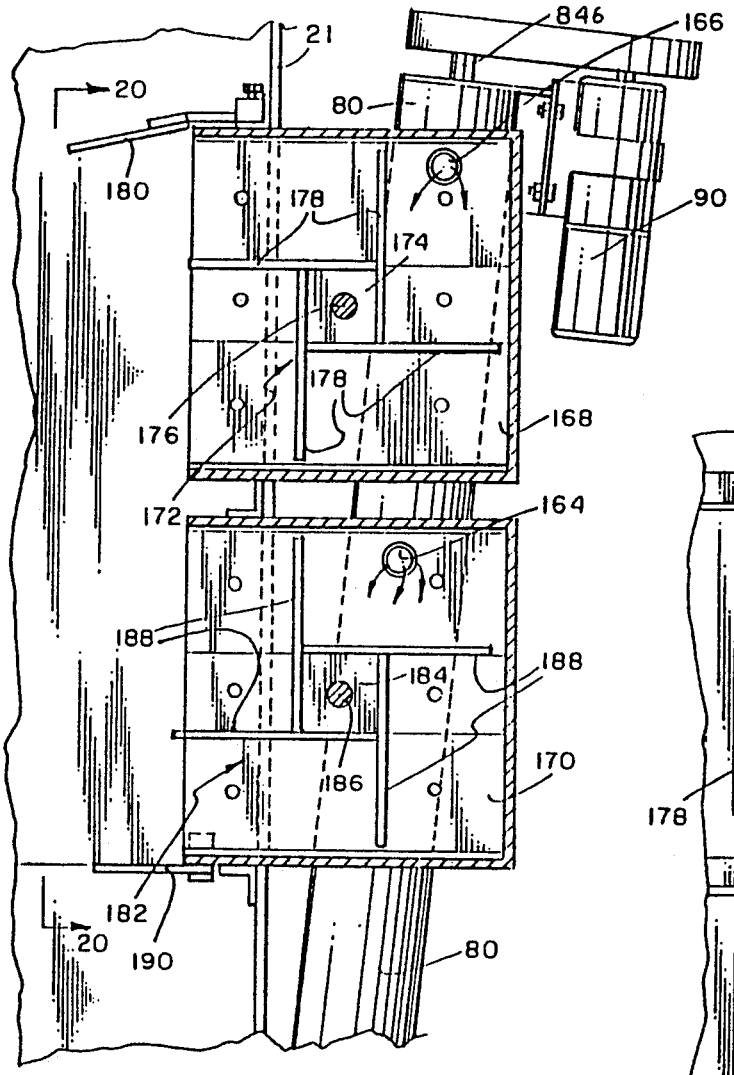
FIG. 19 is a vertical sectional view taken in direction of the arrows and along the plane of line 19—19 in FIG. 2.
Figure 21:
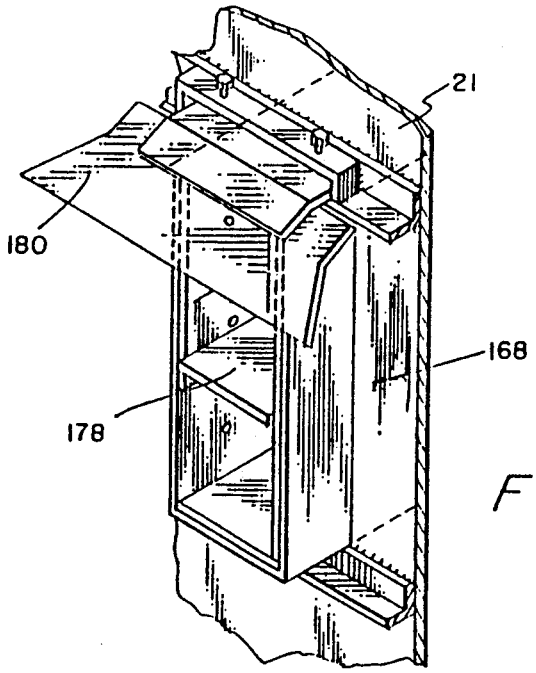
FIG. 21 is a partial perspective view of one of the impeller housings communicating with the inside of the housing of the apparatus and having a ricochet shield disposed over the opening of the impeller housing.
Figure 22:
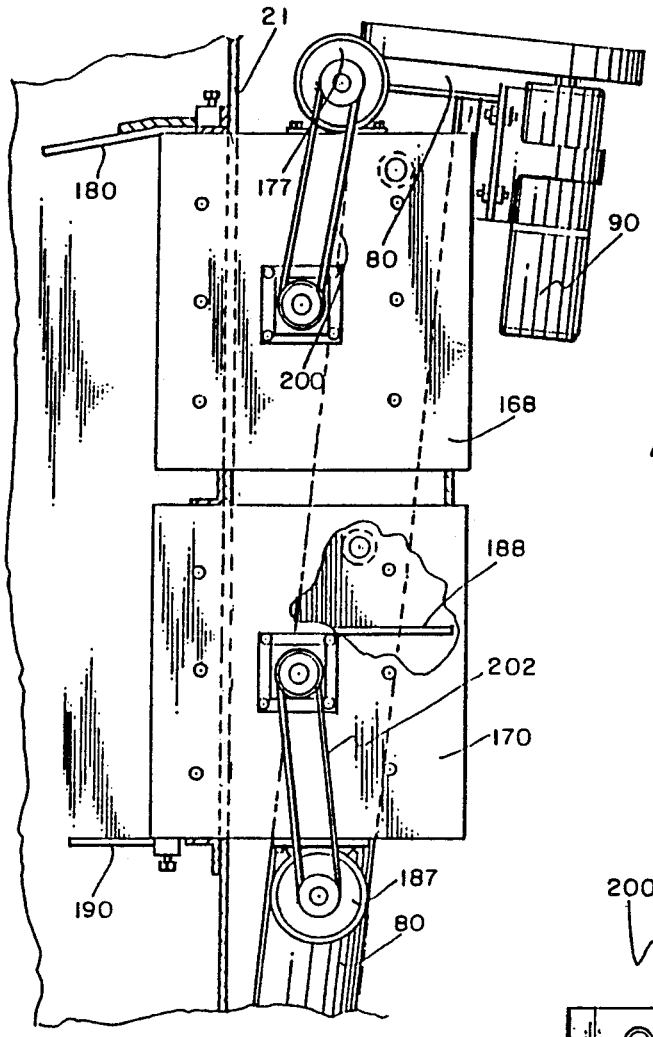
FIG. 22 is a vertical view taken in direction of the arrows and along the plane of line 22—22 in FIG. 20.
Figure 23:
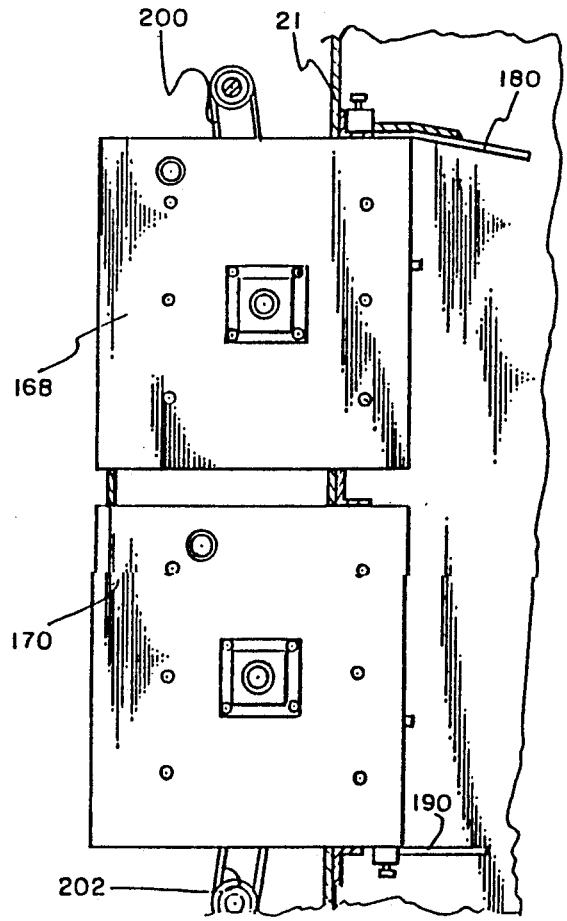
FIG. 23 is a vertical view taken in direction of the arrows and along the plane of line 23—23 in FIG. 20.
Figure 24:
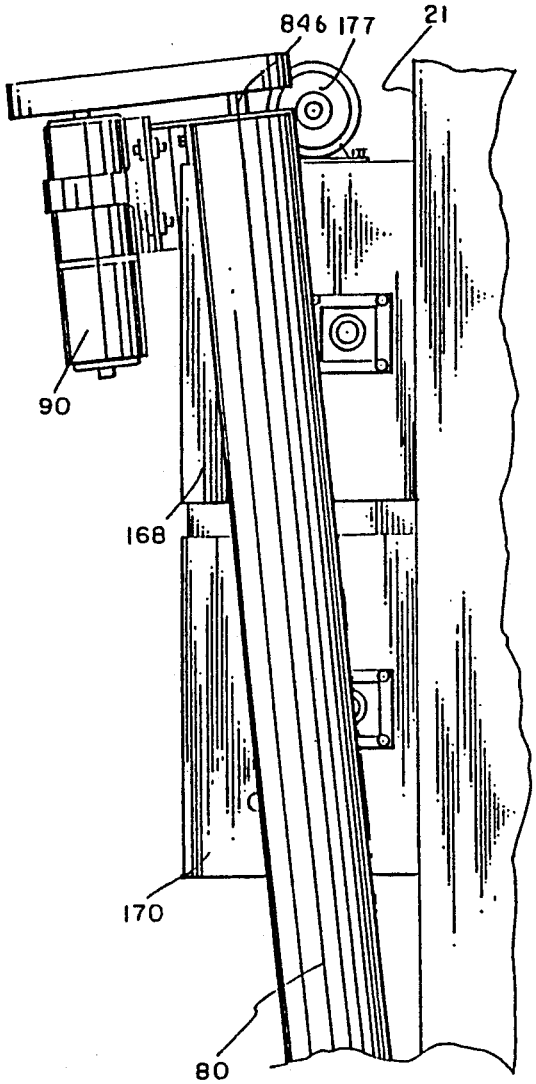
FIG. 24 is a rear elevational view of the canted auger housing having an exposed auger shaft coupled to an auger motor in order to thereby.
Figure 25:
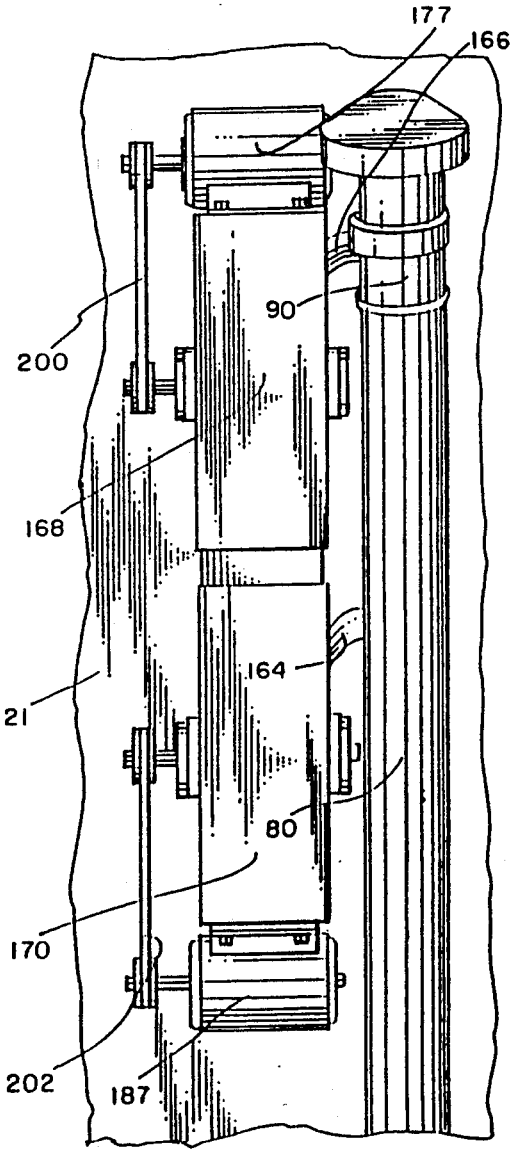
FIG. 25 is a partial front elevational view of the auger housing disposed contiguous to a pair of impeller housings and communicating with the same through a pair of discharge conduits which extend from the auger housing into the pair of impeller housings.
Figure 26:
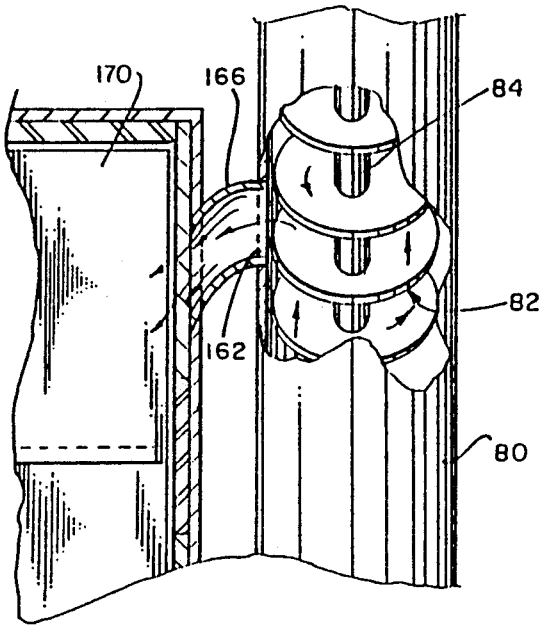
FIG. 26 is a partial vertical sectional view of one of the discharge conduits that is capable of passing pellets from the inside of the auger housing into one of the impeller housings.
Figure 27:
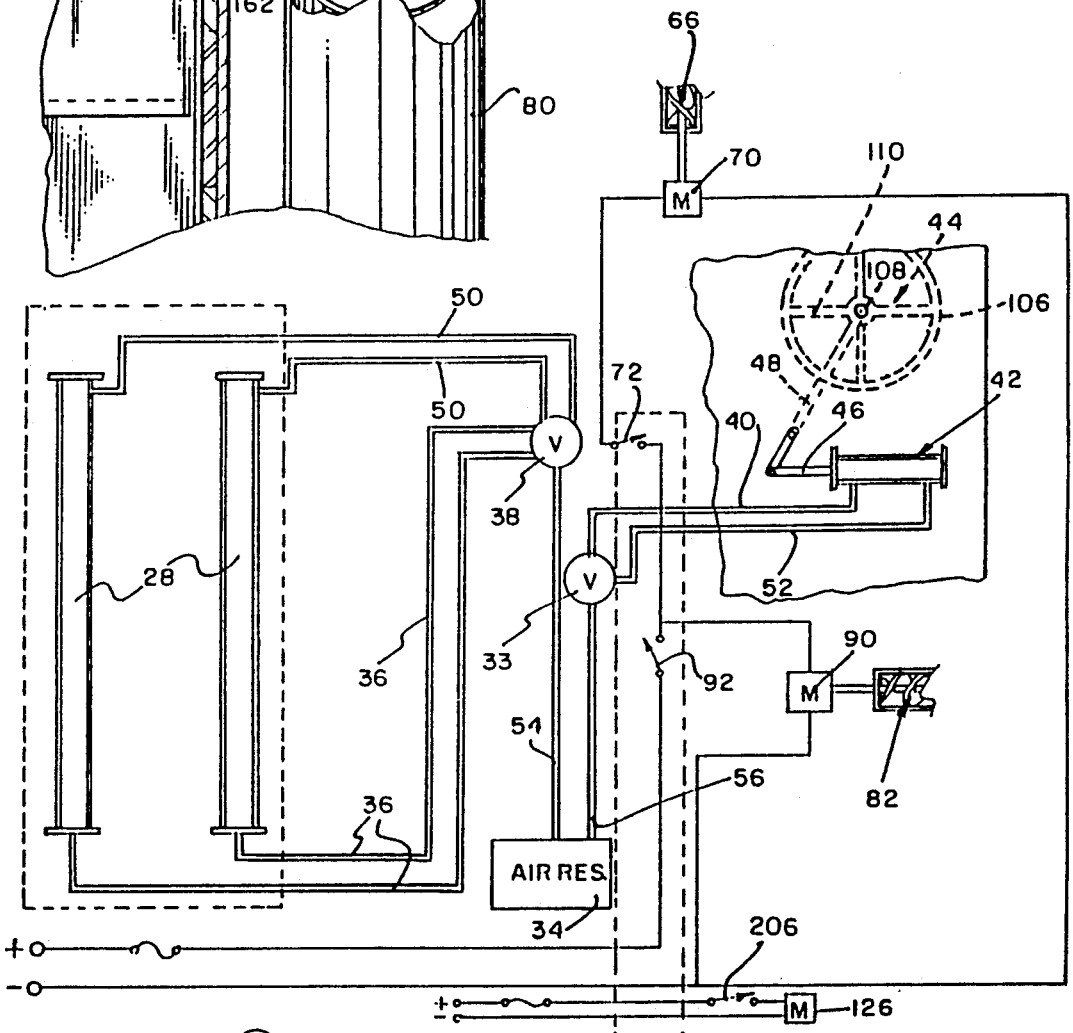
FIG. 27 is an electrical schematic diagram and pneumatic diagram for the apparatus of this invention.
Figure 27:
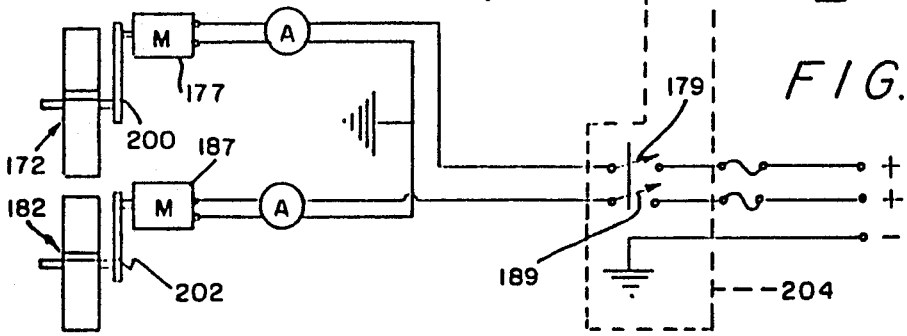

In addition to common opening 76, the sleeve or auger housing 82 is formed with openings 160 and 162. Respectively secured to openings 160 and 162 are chutes or discharge conduits 164 and 166 which further respectively connect and communicate with impeller housing 170 and 168. As the pellets 14 are conveyed or transported vertically within the auger housing 80 by the rotating auger means 82, they fall and pass into discharge conduits 164 and 166 for discharge by gravity into the impeller housings 170 and 168 respectively. The impeller housings 168 and 170 are formed and placed within the side 21 of the housing 16 such that the inside of the impeller housings 168 and 170 communicate with the inside of the housing 16. Rotatably disposed within the impeller housing 168 is an impeller means, generally illustrated as 172. Impeller means 172 includes an impeller hub 174 encased around an impeller shaft 176 that is coupled via endless belt 200 to an impeller motor 177 which functions as a rotatable drive means for the impeller means 172. A switch 179 is provided for energizing the impeller motor 177 as best shown in FIG. 27. Connected to the impeller hub 174 is a plurality of fins or blades 178 that rotate with the impeller hub 174 when the impeller motor 177 is rotatably driving the shaft 176-hub 174 combinations. Attached to the top of the impeller housing 168 on the inside of housing 16 (see FIGS. 19 and 21) is a ricochet shield 180. The impeller means 172, more specifically the rotating fins or blades 178, function as a means for propelling pellets 14, that have been discharged into the impeller housing 168 through discharge conduit 166, towards any articles 12 that are suspendedly engaged to the hanger means 44. The ricochet shield 80 provides a means for ricocheting pellets 14, that have been thrown thereagainst by the blades 178, towards the suspended articles 12.

Figure 20:
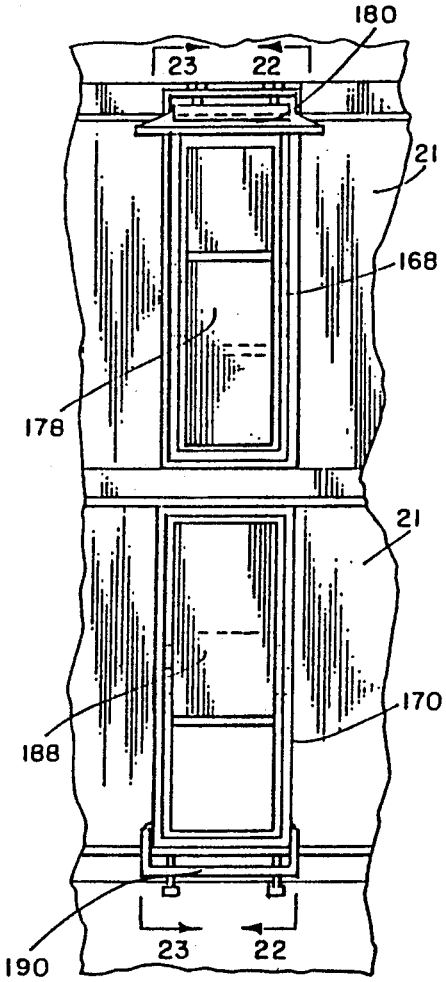
FIG. 20 is a vertical plane view taken in direction of the arrows and along the plane of line 20—20 in FIG. 19.

Rotatably positioned within the impeller housing 170 is an impeller means, generally illustrated as 182, which comprises an impeller hub 184 encased to and around an impeller shaft 186 that has been coupled via endless belt 202 to an impeller motor 187 which functions as a rotatable drive means for the impeller means 182. A switch 189 (see FIG. 27) is furnished for engaging the impeller motor 187. Mounted to the impeller hub 184 is a plurality of fins or blades 188 for rotating with the impeller hub 184 and the impeller shaft 186 when all of the same are being rotatably driven by the impeller motor 187. Connected to the bottom of the impeller housing 170 on the inside of housing 16 (see FIGS. 19 and 20) is a ricochet shield 190. The impeller means 182, more specifically the rotating fins or blades 188, operates and functions as a means for propelling pellets 14 (which have been discharged into the impeller housing 170 through discharge conduit 164) towards any articles 12 that are suspendedly engaged to the hanger means 44. Ricochet shield 190 is similar to ricochet shield 180 in that it provides a means for ricocheting pellets 14 (which have been thrown thereagainst by the blades 188) towards the suspended articles 12.

Figure 12:
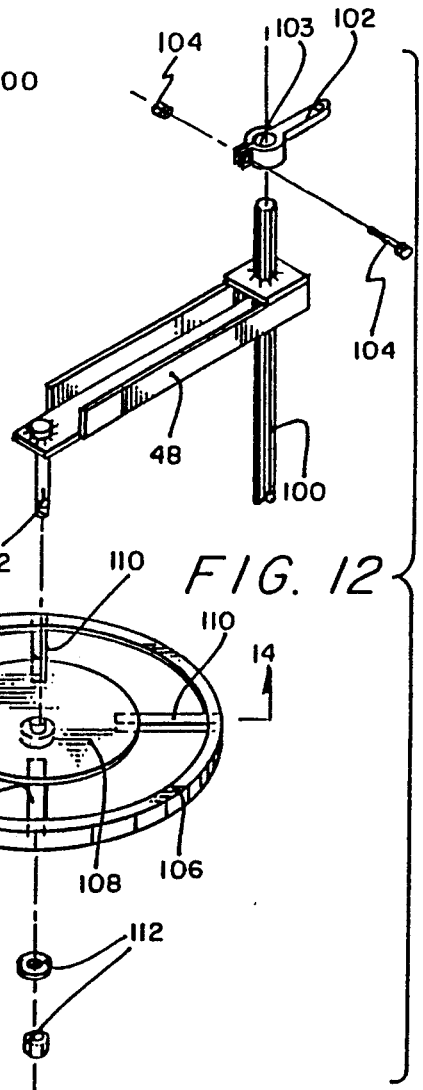
FIG. 12 is a segmented perspective view of part of the hanger which is pivotally disposed within the housing of the apparatus.
Figure 13:
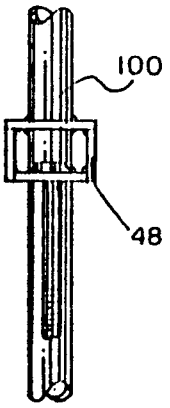
FIG. 13 is a side elevational view of the hanger arm and the shaft to which the hanger arm is bound.
Figure 14:
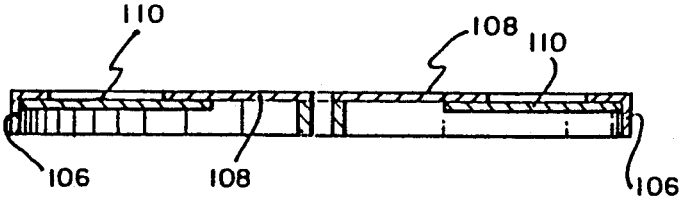
FIG. 14 is a vertical sectional view taken in direction of the arrows and along the plane of line 14—14 in FIG. 12.

The hanger means 44 of this invention is movably, pivotally disposed in the housing 16 and is for holding the articles 12 in a suspended position within the housing 16. Stated alternatively, the hanger means 44 functions as a means for holding the articles 12 while the same are being cleaned with pellets 14. As previously indicated, the hanger means 44 includes a hanger arm 48 that is coupled to the piston 46 of the hanger pneumatic cylinder means 42. Coupling of the piston 46 to the hanger arm 48 is provided by a pivotally mounted hanger shaft 100 (see FIGS. 10 and 12) which extends through the top 27 and down to the bottom 29 of the housing 16 where a bearing 206 engages the lower end of the shaft 100 (see FIG. 10), and a linkage connector 102 with an eyelet 103. The hanger arm 48 is bound to the shaft 100 such as to turn therewith. A bolt-nut combination 104 (see FIG. 12) secures the shaft 100 to the linkage connector 102 after an end of the shaft 100 slidably passes into the eyelet 103. An end of the connector 102 opposed to the eyelet 103 connects to the piston 46 of the hanger hydraulic cylinder means 42. When pneumatic air enters the hanger pneumatic cylinder means 42 at a predetermined location, the piston 46 moves in a predetermined direction. As the piston 46 moves, the attached linkage connector 102 moves, which in turn causes the shaft 100 to turn or rotate. When the shaft 100 turns or rotates counterclockwise, the bound hanger arm 48 also turns or rotates counterclockwise, causing the hanger means 44 to move and swing towards and through the opening 24. Similarly, when the shaft 100 turns or rotates clockwise, the bound hanger arm 48 also turns or rotates clockwise, causing the hanger means 44 at this juncture to move and swing through the opening 24 and towards and into the inside of the housing 16.

The hanger means 44 additionally comprises a hanger wheel 106 and a concentric hub plate 108 with a plurality of radial supports 110 interconnecting the hub plate 108 with the hanger wheel 106. An end of the hanger arm 48 rotatably attaches to the hub plate 108 by a bolt-nut-washer combination 112. The hub plate 108-hanger wheel 106 combination rotates about the end of the hanger arm 48 on the belt 112. Rotation is imparted to the hanger wheel 106 by being in frictional biasing contact with a drive wheel 120 which is mounted to a shaft 122 (see FIG. 16) that rotatably extends through the top 27 of the housing 16 where it is rotatably driven by a motor 126 that is coupled to a gear assembly 124 by a belt 128 for transmitting rotary power from the motor 126 to the gear assembly 124. A switch 206 is provided for energizing the motor 126 (see FIG. 27). The shaft 122 is geared to the gear assembly 124 for rotation when the motor 126 is energized to impart rotary power to the gear assembly 124 via the belt 128. As drive wheel 120 turns, hanger wheel 106 turns when in contact with wheel drive 120. Drive wheel 120 is in frictional contact with the hanger wheel 106 when the hanger means 44 is disposed on the inside of the housing 16, as best shown in FIGS. 15–18. Thus, contact of the hanger wheel 106 with the drive wheel 120 is controlled by the hanger pneumatic cylinder means 42. When it is desired to disengage the frictional contact of the hanger wheel 106 with the drive wheel 120, the hanger pneumatic cylinder means 42 is activated to move the piston 46 in the desired direction which causes the linkage connector 102 to move and rotate the shaft 100 counterclockwise. As the shaft 100 rotates counterclockwise, the hanger means 44 is swung towards the opening 24, releasing the frictional contact of drive wheel 120 with the hanger wheel 106. Similarly, when it is desired to engage a frictional biasing contact between the hanger wheel 106 and the drive wheel 120, the hanger pneumatic cylinder means 42 is activated to move the piston 46 in the desired direction that causes the linkage connector 102 to move and rotate the shaft 100 clockwise, which clockwise rotation causes the hanger means 44 to swing through the opening 24 and into the inside of the housing 16 such that the drive wheel 120 functionally contacts the hanger wheel 106. Pneumatic cylinder means 42 continually urges piston 46 outwardly (see FIG. 11) to continually place a clockwise torque on the connector 102-shaft 100 combination which in turn creates a clockwise torque or force on hanger arm 48 to produce a continual biasing force of the hanger wheel 106 against the drive wheel 120. When the hanger wheel 106 and the drive wheel 120 are in such contact and it is desired to rotate the hanger wheel 106, the motor 126 is energized to cause the shaft 122 to rotate via the belt 128-gear assembly 124 combination. As previously indicated, when shaft 122 rotates, the drive wheel 120 rotates which in turn causes the hanger wheel 106 to rotate due to the biasing, frictional contact between the drive wheel 120 and the hanger wheel 106.

Figure 17:
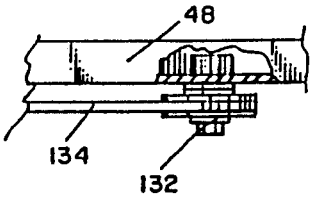
FIG. 17 is a vertical sectional view taken in direction of the arrows and along the plane of line 17—17 in FIG. 15.
Figure 18:
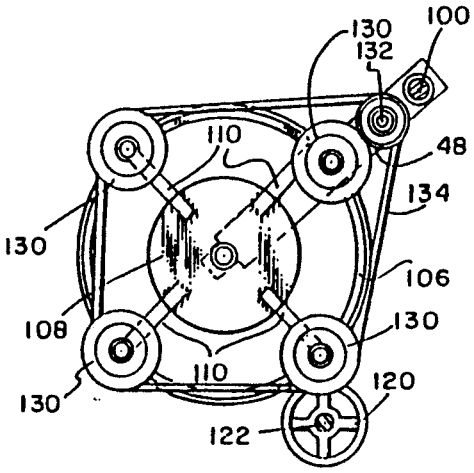
FIG. 18 is a horizontal plane view taken in direction of the arrows and along the plane of line 18—18 in FIG. 16.

In one preferred embodiment of the hanger means 44, four sheaves 130-130-130-130 are rotatably secured to the hanger wheel 106 underneath thereof in a depending fashion. At least one chain member 131 is mounted to each of the sheaves 130 for engaging and holding an article 12. A take-up pulley 132 (see FIG. 17) is rotatably mounted to the bottom of the hanger arm 48 as best illustrated in FIGS. 17 and 18. An endless belt 134 is trained at any point in time around the take-up pulley 132 and three of the sheaves 130-130-130-130. As a rotational drive wheel 120 causes the hanger wheel 106 to rotate and/or turn about its axis, the turning movement in combination with centrifugal force further causes the individual sheaves 130 to rotate about each of their respective axes. Thus, an article 12 on a particular sheave 130 has two rotational movements; namely, a rotational movement about the centric axis (at bolt 112) of the hanger wheel 106 due to rotary power being imparted or transmitted to the hanger wheel 106 from a rotating drive wheel 120, and a rotational movement about the concentric axis of the particular sheave 130 which is being rotated by the turning movement of the hanger wheel 106 in combination with the centrifugal force in proximity to the periphery of hanger wheel 106. Furthermore, as a result of the two rotational movements, an article 12 secured to an end of a chain member 131 has a tendency to swing and/or flare outwardly which could develop and provide additional centrifugal force that could be placed on and/or conducted through and up the length of a chain member 131 to the central part of the sheave 130 where the additional centrifugal force develops a central torque in proximity to the center thereof. The central torque alone on the central part could cause a particular sheave 130 to rotate. Typically, the central torque further causes each particular sheave 130 to rotate, separate from the rotation caused by the combination of the rotating hanger wheel 106 and the centrifugal force on the periphery of the hanger wheel 106.

As the hanger wheel 106 revolves and turns, the plurality of sheaves 130 turn therewith. Furthermore, as indicated, each of the sheaves 130 commence rotating individually about their respective axis. The endless belt 134 trained over the take-up pulley 132 and three of the sheaves 130-130-130-130 insures that each of the sheaves 130 individually rotate about their respective axis at the same rate. The rate of rotation of the individual sheaves 130 is directly proportional to the speed or rate of movement or travel of the endless belt 134. As the plurality of sheaves 130-130-130-130 turn with the hanger wheel 106, each particular sheave 130 goes through point in time where it is no longer trained to or in contact with the endless belt 134. As best illustrated in FIG. 18, as each particular sheave 130 approaches the take-up pulley 132, it loses contact with the endless belt 134 until passing the take-up pulley 132. When each particular sheave 130 becomes disengaged from the endless belt 134 and loses contact with the same, the rotational speed of the particular sheave 130 about its axis would tend to change with respect to the rotational speed of the other sheaves 130 that are in engagement with the endless belt 134. This change in rotational speed would be momentary however because as soon as the particular sheave 130 passes the take-up pulley 132, it becomes reengaged with the endless belt 134, causing the rotational speed of the particular sheave 130 to resume the speed or rate of movement of the endless belt 134. The cycle is repeated for the immediate subsequent sheave 130 to the particular sheave 130 that has become reengaged with the endless belt 134.

In another preferred embodiment of the hanger means 44, the hub plate 108 has concentrically mounted thereto a support flange means, generally illustrated as 140, in FIGS. 5, 10, 28 and 29, for supporting an article 22 suspended therefrom by chain members 131 which connect to the support flange means 140. The support flange means 140 has a generally circular base plate 142 and a hub 144 which is bound concentrically to the hub plate 108 of the hanger means 44. The support flange means 140 including the base plate 142 and the hub 144 rotate with the hub plate 108 and the hanger wheel 106. Preferably, two or more chain members 131 connect to the base plate 142 of the support flange means 140 as best shown in FIGS. 10 and 28 where there are three chain members 131-131-131 suspended from the base plate 142 and engaged to an article 12 (e.g., an engine block or the like). In this embodiment of the invention, as the drive wheel 120 rotates when in frictional contact with the hanger wheel 106, hanger wheel 106 and he interconnected hub plate 108 also rotate. As the hub plate 108 rotates, the bound hub 144 and base plate 142 also rotate, causing the chain members 131 and any article 12 suspended therefrom to rotate simultaneously therewith. It is to be understood that this preferred embodiment of the hanger means 44 in the present invention may be employed in combination with the preferred embodiment of the hanger means 44 in FIGS. 15–18. Such combination is provided by concentrically mounting the support flange means 140 onto the hub plate 108 in FIGS. 15–18 such that the support flange means 140 (more specifically, the circular base plate 142 and the concentric hub 144) is surrounded by the sheaves 130 which are rotatably disposed generally equidistantly therefrom on and along the periphery of the hanger wheel 106. As was previously indicated, articles 12 held by the chain members 131 can be pelletized in the housing 16 of the apparatus 10 of this invention.

Figure 1:
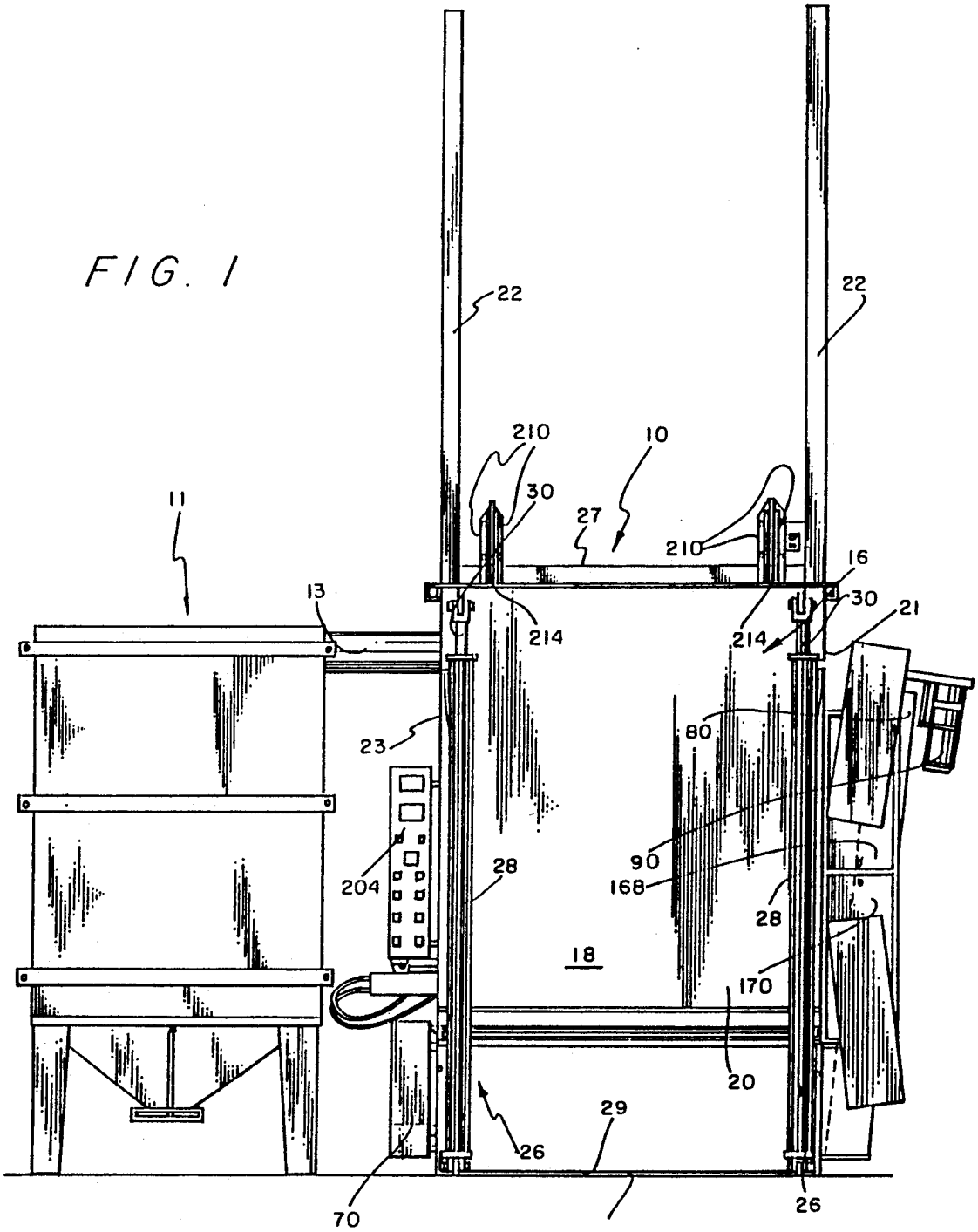
FIG. 1 is a front elevational view of the apparatus of this invention.
Figure 4:
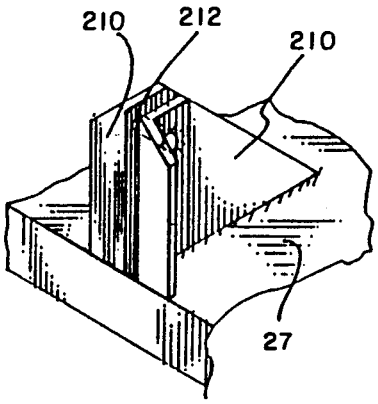
FIG. 4 is a partial perspective view of a pair of spaced brackets interconnected by a lug bar and mounted to the roof of the apparatus, and which functions to assist in firmly sealing shut the door of the apparatus.

Connected to the side of the housing 16 is a control panel 204 (see FIG. 1) which contains switches 72, 92, 177, 187 and 206. The top 27 of the housing 16 is formed with two pairs of a pair of upright brackets 210-210 interconnected by a lug bar 212 (see FIG. 4). Mounted to the top of the door 20 is a pair of generally L-shaped hooks or latching members 214-214 (see FIG. 2). The L-shaped hooks or latching members 214-214 pass between the respective pair of upright brackets 210-210 and hook over, or latch to, the respective lug bars 212 such as to firmly seal the door 20 in place and cover the opening 24. As was previously indicated, door 20 is closed by depressurizing conduits 36-36 and pressuring conduits 50-50 through the proper positioning of valve 38 which is in direct communication with the compressor or air reservoir 34 through conduit 54. After the door 20 has been completely closed, the valve 38 is left in position such that continually air pressure is contained in the conduits 50-50 in order to firmly maintain the door 20 closed due to the pistons 30-30 of the pneumatic cylinders 28-28 being continually biased downwardly.

With continuing reference to the drawings for operation of the invention, valve 38 is moved to release pressurized air from the compressor 34 through the conduit 54, through the conduits 36-36 and into the two pneumatic cylinder means 28-28. This causes the two pistons 30-30 of the pneumatic cylinder means 28-28 to start travelling (or be driven) upwardly. The pistons 30-30 are coupled to the door 20 by the door brackets 32-32. As the pistons 30-30 travel upwardly, the two L-shaped hooks 214-214 are released from around the respective lug bars 212 of the pair of upright brackets 210-210 and the door 20 travels up along the tracks 22-22 with the pistons 30-30 to expose the opening 24. After the door 20 has been elevated to its uppermost position, valve 33 is moved to release pressurized air from the compressor 34, through conduit 56, and through the conduit 40 and into the hanger pneumatic cylinder means 42. This causes the piston 46 to commence sliding into the pneumatic cylinder means 42, which in turn causes the shaft 100 through the linkage connector 102 to rotate counterclockwise. As the shaft 100 rotates counterclockwise, the hanger arm 48 bound to the shaft 100 also rotates counterclockwise which causes the hanger wheel 106 to swing through the opening 24 as depicted in the dotted line representations of FIG. 7 and FIG. 11. The ends of chains 131, connected to and extending down from the sheaves 130 in FIGS. 15–18 or from the base plate 142 of the flange means in FIGS. 5 and 10, are now available to be engaged to any article(s) 12 which are to be abrasively cleaned with pellets 14. After attaching the article(s) 12 to the ends of the chains 131, valve 33 is moved to depressurize conduit 40 and to release pressurized air through conduit 52 causing the piston 46 to expand and move outwardly from the pneumatic cylinder means 42 which causes the shaft 100 through linkage connector 102 to move and rotate clockwise. This clockwise rotation causes the hanger arm 48, along with the hanger wheel 106 having suspended therefrom the article(s) 12, to swing through the opening 24 and into the inside of the housing 16 such that the hanger wheel 106 comes in frictional contact with the drive wheel 120. The valve 33 is left in the latest position which causes pneumatic cylinder means 42 to continually urge piston 46 outwardly and away from the pneumatic cylinder means 42 to continually place a clockwise torque on the connector 102-shaft 100 assembly. This creates a clockwise torque or force on hanger arm 48 and produces the continual biasing of the hanger wheel 106 against the drive wheel 120. The suspended apparatus 12 is now postured to be pelletized.

After ensuring that there are sufficient pellets 14 within the housing 16, the door 20 is lowered from its uppermost, elevated position. The procedure to close the door 20 is the reverse of the procedure for opening the door 20. More specifically, valve 38 is moved to initially release pressurized air from conduits 36-36, and to subsequently release or direct the pressurized air from the compressor 34 via conduit 56 into and through conduits 50-50 and into the pneumatic cylinder means 28-28 to drive the expanded two pistons 30-30 downward to lessen the length of same outside of the cylinder means 28-28, all of which causes the opening 24 to close off due to the lowering of the door 20. After the door 20 is completely closed such that the L-shaped hook members 214-214 have passed in between the respective pair of upright brackets 210-210 and have hooked over the respective lug bars 212 which interconnect the upright brackets 210-210, the valve 38 is left in the latest position such that continually pneumatic pressure is contained in the conduits 50-50 in order to firmly maintain the door 20 in a closed posture due to the pistons 30-30 of the pneumatic cylinders 28-28 being continually biased downward or towards the ground.

With the valves 33 and 38 left in their latest position, switches 72 and 92 are subsequently closed to energize or activate motors 70 and 90 respectively. Similarly, switches 206, 179 and 189 are closed to energize motors 126, 177 and 187. Energization of motors 177 and 187 causes the blades (i.e., blades 178 and 188) of the respective impeller means 172 and 182 to rotate or revolve, and with the energization of motor 70, auger means 66 starts to rotate and move pellets 14 through the partition apertures 78, through the common opening 76 and into the auger housing 80. Similarly, with the energization of motor 90, auger means 82 commences to rotate or revolve with the auger housing 80 and move pellets 14 received from the auger means 66 vertically up and away from the housing 16, since the auger means 82 has an auger shaft 84 with an axis that forms an oblique angle with the axis of the auger means 66. As the pellets 14 are being transported or conveyed upwardly within the auger housing 80 by the rotating auger means 82, they pass through openings 160 or 162 and into discharge conduits 164 or 166. The pellets 14 that were augered by opening 160 are eventually discharged through opening 162 and into the conduit 166.

Energization of the motor 126 causes the shaft 122 to rotate by the transfer of rotary power from the motor 126 to the shaft 122 through the belt 128-gear assembly combination. As shaft 122 rotates, the drive wheel 120 rotates. As the drive wheel 120 rotates, the hanger wheel 106 starts rotating from the biased, frictional contact between the drive wheel 120 and the hanger wheel 106. With the hanger wheel 106 rotating, article(s) 12 suspended therefrom by the chains 131 in the preferred embodiment of FIGS. 15-18 rotate about a first axis (i.e., the axis of the rotating hanger wheel 106) while simultaneously rotating about a second axis (i.e., the axis of the rotating sheaves 130 which are caused to be rotated as indicated above). In the embodiment of FIGS. 5, 10, 28 and 29, the suspended articles 131 only rotate by the axis of the rotating hanger wheel 106.

After the pellets 14 being augered by auger means 82 pass through the conduits 166 and 164, they discharge into the respective impeller housings 168 and 170 where they encounter a revolving impeller means 172 and a revolving impeller means 182, respectively. The revolving blades 178 of the impeller means 172 slap, or other propel, the pellets 14 from conduit 166 towards the revolving, suspended article 12. Similarly, the revolving blades 188 of the impeller means 182 slap, or otherwise propel, the pellets 14 from the conduit 164 towards the revolving, suspended article 12. When the pellets 14 contact the article 12, it is abrasively being cleaned, similar to a sand-blasting operation. After the pellets 14 have contacted the article 12, they fall onto the downwardly sloping floors 58-58 and slide into the trough 60. From the trough 60, the pellets 14 pass through the plurality of apertures 60 in the trough 60 and into the auger housing 64 where a revolving auger means 66 receives the pellets 14 and starts the transfer process all over again. When the article 12 has been sufficiently cleaned, switches 179 and 189 are opened to deenergize the impeller motors 177 and 187, respectively, and terminate the propulsion of pellets 14 towards the article 12. Similarly, switch 206 is opened to deenergize motor 126 and stop the hanger wheel 106 (and the article 12) from revolving, and switches 72 and 92 are also deenergized to respectively deenergize auger means 66 and 82 and stop the transporting of pellets 14 towards and into the impeller housings 168 and 170. Door 20 may now be opened with valve 38 in accordance with the procedure previously mentioned. Similarly, the hanger means 44, more specifically the hanger arm 48-hanger wheel 106 combination of the hanger means 44, may be swung through the opening 24 (see dotted line representation in FIGS. 7 and 11) through the movement of valve 33, in accordance with the same procedure previously mentioned above, to facilitate the removal of cleaned articles 12 from the chains 131.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A method for cleaning articles with pellets comprising the steps of:

(a) providing a housing means for cleaning articles and a first auger means rotatably disposed therein and rotatably passing therethrough for conveying pellets out of the housing means after the pellets have been discharged therein for contacting an article for cleaning the same;

(b) providing a second auger means rotatably disposed on the outside of said housing means and communicating with said first auger means for receiving and transporting pellets therefrom;

(c) forming an auger shaft bearing means with pellets at an end of the second auger means to provide a bearing for the end of the second auger means;

(d) providing at least one means for propelling pellets towards an article disposed in the housing means, said means for propelling being provided such as to communicate with said second auger means for receiving pellets therefrom;

(e) disposing an article in said housing means;

(f) propelling pellets towards said article of step (d) with said means for propelling pellets of step (c);

(g) conveying pellets with said first auger means out of said housing means and discharging said pellets into said second auger means; and (h) transporting said pellets with said second auger means into said means for propelling pellets of step (c) such that said means for propelling pellets can propel the pellets towards the article.

2. The method of claim 1 additionally comprising rotating said article about a first axis in said housing means.

3. The method of claim 2 additionally comprising simultaneously rotating said articles about a second axis in said housing means.

4. The method of claim 1 wherein said transporting step (g) comprises conveying said pellets up and away from said housing means.

5. The method of claim 1 wherein said transporting step (g) comprises conveying said pellets up and towards said housing means.

6. The method of claim 1 additionally comprising replenishing said auger shaft bearing means with at least one pellet after at least one of said pellets has been generally crushed.

7. A method for cleaning articles with pellets comprising the steps of:

(a) providing a housing means for cleaning articles and a first auger means having a first auger axis and rotatably disposed therein and rotatably passing therethrough for conveying pellets along a first auger path and out of the housing means after the pellets have been discharged therein for contacting an article for cleaning the same;

(b) providing a second auger means having a second auger axis that is obliquely disposed with respect to the first auger axis and is rotatably disposed on the outside of said housing means and communicating with said first auger means for receiving and transporting pellets therefrom along a second auger path;

(c) providing at least one means for propelling pellets towards an article disposed in the housing means, said means for propelling being provided such as to communicate with said second auger means for receiving pellets therefrom;

(d) disposing an article in said housing means;

(e) propelling pellets towards said article of step (d) with said means for propelling pellets of step (c);

(f) conveying pellets with said first auger means along said first auger path and out of said housing means and discharging said pellets directly into said second auger means; and (g) transporting said pellets with said second auger means along said second auger path which forms an oblique angle with respect to said first auger path and into said means for propelling pellets of step (c) such that said means for propelling pellets can propel the pellets towards the article.

8. The method of claim 7 additionally comprising rotating said article about a first axis in said housing means.

9. The method of claim 8 additionally comprising simultaneously rotating said articles about a second axis in said housing means.

10. The method of claim 7 wherein said transporting step (g) comprises conveying said pellets up and away from said housing means.

11. The method of claim 7 wherein said transporting step (g) comprises conveying said pellets up and towards from said housing means.

12. The method of claim 7 additionally comprising forming an auger shaft bearing means with said pellets at an end of said second auger means.

13. The method of claim 12 additionally comprising replenishing said auger shaft bearing means with at least one pellet after at least one of said pellets has been generally crushed.

14. The method of claim 7 wherein said second auger axis has an angle ranging from about 91 degrees to about 135 degrees with respect to the first auger axis.

* * * * *